US006296440B1

(12) United States Patent
Fandrey

(10) Patent No.: US 6,296,440 B1
(45) Date of Patent: Oct. 2, 2001

(54) SIDE CHANNEL CENTRIFUGAL PUMP

(75) Inventor: Peter Fandrey, Glückstadt (DE)

(73) Assignee: Sterling Fluid Systems (Germany) GmbH, Itzehoe (DE)

( * ) Notice: Subject to any disclaimer, the term of this patent is extended or adjusted under 35 U.S.C. 154(b) by 0 days.

(21) Appl. No.: 09/529,845

(22) PCT Filed: Nov. 10, 1997

(86) PCT No.: PCT/EP97/06236

§ 371 Date: Apr. 20, 2000

§ 102(e) Date: Apr. 20, 2000

(87) PCT Pub. No.: WO99/24719

PCT Pub. Date: May 20, 1999

(51) Int. Cl.[7] ..... F04D 1/04
(52) U.S. Cl. ..... 415/55.1
(58) Field of Search ..... 415/55.1, 55.2, 415/55.3, 55.4, 55.5, 55.6, 55.7

(56) References Cited

U.S. PATENT DOCUMENTS 5,336,045 * 8/1994 Koyama et al. ..... 415/55.1
5,401,147 * 3/1995 Yu ..... 417/423.14
5,486,087 * 1/1996 Treiber et al. ..... 415/55.1
6,086,325 * 7/2000 Ellinghaus ..... 415/55.4
6,126,387 * 10/2000 Yoshida et al. ..... 415/55.3

FOREIGN PATENT DOCUMENTS 1196016 7/1965 (DE) .
36 44 356 7/1988 (DE) .
1281842 2/1970 (GB) .

* cited by examiner

*Primary Examiner*—Edward K. Look
*Assistant Examiner*—James M. McAleenan
(74) *Attorney, Agent, or Firm*—Alix, Yale & Ristas, LLP

(57) ABSTRACT

The invention relates to a side channel centrifugal pump with a housing forming a side channel (1). The housing surface adjacent to the side channel forms a front face (13) adjoining the impeller. The transition edge (2, 3, 7) between the side channel (1) and the front face (13) is rounded in the areas where it deviates from the circumferential direction. In the front plane, the blades (16) of the impeller have a predetermined web width in the circumferential direction. According to the invention, the radius (15) of the transition edge (7) is greater than 0.25 (sec/m) times the product of web width×blade speed where the impeller blades (16) exit from the front face (13, 14) and overlap into the area of the side channel (1). This reduces cavitation tilting and noise.

11 Claims, 1 Drawing Sheet

IV
V
VI

SIDE CHANNEL CENTRIFUGAL PUMP

CROSS-REFERENCE TO RELATED APPLICATIONS

This is the national stage of International Application No. PCT/EP97/06236 filed Nov. 10, 1997.

BACKGROUND OF THE INVENTION

The invention relates to a side-channel centrifugal pump having a housing which forms a side channel and whose surface which is adjacent to the side channel forms a front face which is contiguous to the impeller except for a narrow gap, the transition edge from the side channel to the front face being rounded in those regions where it deviates from the circumferential direction, and having an impeller whose vanes have a predetermined web width in the circumferential direction in the front plane of the impeller.

Side-channel pumps are used, inter alia, whenever a high pressure is to be obtained in conjunction with a small conveying flow. A disadvantage of these pumps is the cavitation tendency at those locations on the housing where it has sudden changes in its shape in the direct vicinity of the impeller. Cavitation damage may occur both on the housing and on the impeller. A relatively high level of noise is associated therewith. These disadvantages are particularly noticeable at high rotational speeds, which are understood as being speeds of over 2,800 rpm. Pumps of this type are therefore generally used at a lower rotational speed of around 1,500 rpm.

In the case of the similarly constructed peripheral pumps (DE-A 40 02 027) it is known to provide the transition edge from a wide housing part to the front face of the housing, specifically in the region of the outlet opening, with a rounded portion, in order thereby to reduce the generation of noise.

SUMMARY OF THE INVENTION

The invention is based on the object of reducing the cavitation tendency and generation of noise in a pump of the type mentioned at the beginning. The invention is further based on the recognition that cavitation and formation of noise should be taken into account not only at those locations where the flow rate of the conveyed medium is particularly great, but also at other transition edges. The invention is furthermore based on the recognition that a rounded portion only achieves an optimum effect if its radius of curvature is matched to the vane speed and the web width of the vanes. The vane speed is understood to be its circumferential speed at the location under consideration in each case. The web width is understood to be the width of the impeller in the circumferential direction in the front plane of the impeller. The greater the vane speed and the web width, the larger the rounded portion should be.

The effect of the rounded portion resides in the fact that the vane edge, on reaching the end of the front face and the beginning of the side channel, does not enter suddenly into the liquid which is virtually at rest there, but rather already prior to this in the region of the rounded portion a circulating flow is built up around the vane edges, leading to pressure equalization and reducing the impact. This preparatory circulating flow is more intense the higher the relative speed of the vane is with respect to the housing edge and the shorter the rounded portion is. It has furthermore been established that the said circulating flow proceeds more favourably the smaller the web width of the vane is. The teaching of the invention for the first time takes into consideration this inter-relationship between these effects and the use of a certain minimum value of the ratio of the edge radius and web width for a given vane speed.

This rounded portion is expediently also used on the corresponding edges of the air-displacing channel, if such a channel is present. It may also be expedient not only for the edges at which the vanes emerge from the region of the front face and pass into the region of the side channel or of the air-displacing channel, to be rounded in the specified manner, but also those edges where the vanes emerge from the region of the side channel or air-displacing channel and pass into the region of the front face.

Since the rounded portion reduces the effective circumferential length of the sealing region between the end and the beginning of the side channel (apex region), provision is made according to the invention for this circumferential length including the rounded section to amount at least to the spacing of 2.5 vanes. It has furthermore proven expedient for the depth of the side channel to increase shortly before its end.

BRIEF DESCRIPTION OF THE DRAWINGS

The invention is explained in more detail below with reference to the drawing, which illustrates an advantageous exemplary embodiment. In the drawing.

DETAILED DESCRIPTION OF THE PREFERRED EMBODIMENTS

Figures 1, 2, 3, 4, 5, 6:
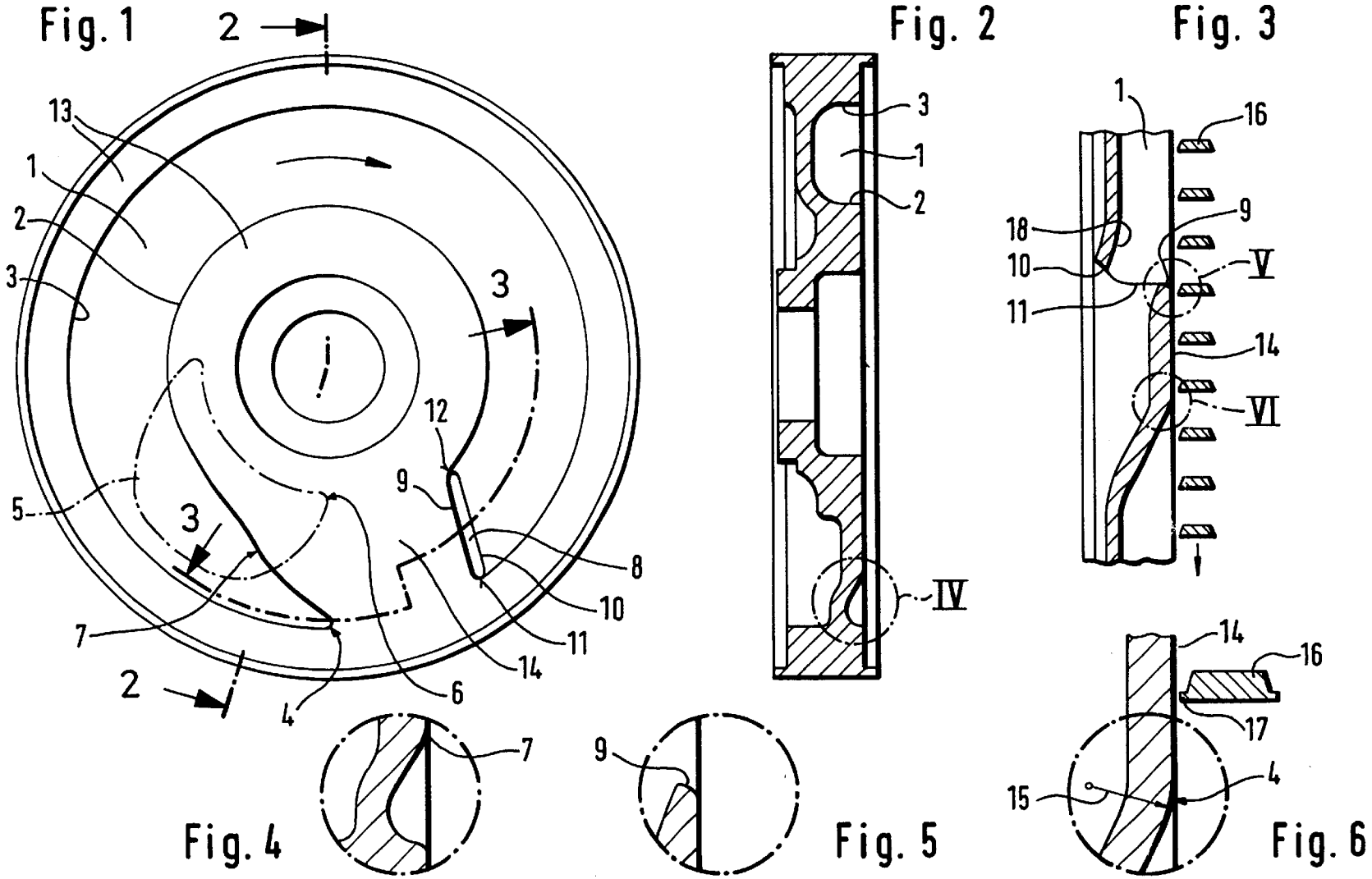
FIG. 1 shows a plan view of a housing part which forms the side channel.
FIG. 2 shows a section along the line A–B of FIG. 1.
FIG. 3 shows a cylindrical section along the line C–D of FIG. 1.
FIG. 4–6 show detail enlargements of the regions designated IV–VI in FIG. 2 and 3.

The basic construction of the side-channel pump follows the design disclosed in DE-C974737: two housing parts enclose a tightly restricted operating space for an impeller, which space is only expanded in the region of one of these two housing parts, which is illustrated in the drawing, in order to form the side channel 1. The side channel 1 is restricted radially inwards by the edge 2 and outwards by the edge 3. It begins at point 4 at the same angular location at which the suction opening 5, whose outline is indicated in FIG. 1 by dash-dotted lines, begins radially further inwards at point 6. The suction opening is situated in the other housing part, which is not illustrated in the drawing. In the region of this suction opening the side channel expands with an appropriately sloping profile of its inner-edge 7 until, approximately 60–90° after its beginning, it reaches its final cross section, which is seen at the top in FIG. 2. It maintains the said final cross section as far as the delivery opening 8 through which the medium emerges from the side channel. The delivery opening is bounded by the side boundaries 11, 12, by the side-channel bottom 10 and also by the edge 9 (FIG. 3).

Radially within the inner boundary edge 2, outside the outer boundary edge 3 and between the starting edge 7 and the final edge 9 of the side channel, the illustrated housing part forms a planar front face, which is contiguous to the impeller (vane 16 in FIG. 3) in the fitted pump, and the said housing part encloses a small sealing gap with its front face 13. This front face also includes the apex region 14 between the final edge 9 and the starting edge 7 of the side channel.

The impeller vanes 16 located in each case in this region have the task of sealing off the difference in pressure between the end (delivery opening 8) and the beginning 4 of the side channel 1 in close cooperation with this face 14. As indicated in FIGS. 3 and 6, in this arrangement the vanes 16, which are indicated in cross section, pass with their web 17 over the face 14 at a short distance, until they reach the edge 7 and at this location enter into a medium which is more or less at rest.

According to the invention, the impact which is associated therewith is reduced by the rounding of the edge 4 in accordance with radius 15, this radius corresponding to the dimensioning rules according to the invention. Its minimum value amounts to 0.25 [sec/m] times the vane circumferential speed [misec] times the web width in the circumferential direction [mm]. The factor is preferably between 0.4 and 0.6. It should not be greater than 1 because otherwise the rounding is so large that it reduces the effective length of the side channel in a disadvantageous manner. The length of the rounding can namely not be increased at the expense of the circumferential length of the apex 14, which circumferential length is determined by encloses a small sealing gap with its front face 13. This front face also includes the apex region 14 between the final edge 9 and the starting edge 7 of the side channel. The impeller vanes 16 located in each case in this region have the task of sealing off the difference in pressure between the end (delivery opening 8) and the beginning 4 of the side channel 1 in close cooperation with this face 14. As indicated in FIGS. 3 and 6, in this arrangement the vanes 16, which are indicated in cross section, pass with their web 17 over the face 14 at a short distance, until they reach the edge 7 and at this location enter into a medium which is more or less at rest.

According to the invention, the impact which is associated therewith is reduced by the rounding of the edge 4 in accordance with radius 15, this radius corresponding to the dimensioning rules according to the invention. Its minimum value amounts to 0.25 [sec/m] times the vane circumferential speed [m/sec] times the web width in the circumferential direction [mm]. The factor is preferably between 0.4 and 0.6. It should not be greater than 1 because otherwise the rounding is so large that it reduces the effective length of the side channel in a disadvantageous manner. The length of the rounding can namely not be increased at the expense of the circumferential length of the apex 14, which circumferential length is determined by the distance between the edge 9 and the beginning 4 of the side channel, because the sealing mentioned above has to be effective in this region.

In the case of side-channel pumps which are intended for conveying a relatively large proportion of gas in the conveying medium, provision is frequently made in the apex region 14 of a special grooved depression which runs obliquely to the circumferential direction and is generally referred to as an air-displacing channel and is connected to a gas-exit opening.

What is claimed is:

1. Side-channel centrifugal pump having a housing which forms a side channel (1) and whose surface which is adjacent to the side channel (1) forms a front face (13) which is contiguous to the impeller except for a narrow gap, the transition edge (2, 3, 7) from the side channel (1) to the front face (13) being rounded in those regions where it deviates from the circumferential direction, and having an impeller whose vanes (16) have a predetermined web width in the circumferential direction in the front plane of the impeller, characterized in that the radius (15) of the transition edge (7) in the region where the vanes (16) of the impeller emerge from the region of the front face (13, 14) and pass into the region of the side channel (1) is greater than 0.25 sec/m times the product of the web width and vane speed.

2. Side-channel pump according to claim 1, characterized in that this edge rounding is provided in an air-displacing channel.

3. Side-channel pump according to claim 2, characterized in that the transition edges (9) at which the vanes (17) emerge from the side channel (1) or the air-displacing channel and pass into the region of the front face (13, 14) are also rounded.

4. Side-channel pump according to claim 2, characterized in that the depth of the side channel (1) increases at its end.

5. Side-channel pump according to claim 2, characterized in that the circumferential spacing between the end (9) and the beginning (4) of the side channel (1) amounts at least to the spacing of 2.5 vanes.

6. Side-channel pump according to claim 1, characterized in that the transition edges (9) at which the vanes (17) emerge from the side channel (1) or the air-displacing channel and pass into the region of the front face (13, 14) are also rounded.

7. Side-channel pump according to claim 6, characterized in that the depth of the side channel (1) increases at its end.

8. Side-channel pump according to claim 6, characterized in that the circumferential spacing between the end (9) and the beginning (4) of the side channel (1) amounts at least to the spacing of 2.5 vanes.

9. Side-channel pump according claim 1, characterized in that the depth of the side channel (1) increases at its end.

10. Side-channel pump according to claim 9, characterized in that the circumferential spacing between the end (9) and the beginning (4) of the side channel (1) amounts at least to the spacing of 2.5 vanes.

11. Side-channel pump according to claim 1, characterized in that the circumferential spacing between the end (9) and the beginning (4) of the side channel (1) amounts at least to the spacing of 2.5 vanes.

* * * * *